US010361022B2

(12) United States Patent
Lint

(10) Patent No.: US 10,361,022 B2
(45) **Date of Patent: *Jul. 23, 2019**

(54) ADVANCED ELECTRONIC HEADER APPARATUS AND METHODS

(71) Applicant: Pulse Electronics, Inc., San Diego, CA (US)

(72) Inventor: James Douglas Lint, Cardiff, CA (US)

(73) Assignee: Pulse Electronics, Inc., Cardiff, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/133,507

(22) Filed: Sep. 17, 2018

(65) Prior Publication Data

US 2019/0122802 A1 Apr. 25, 2019

Related U.S. Application Data

(63) Continuation of application No. 15/589,809, filed on May 8, 2017, now Pat. No. 10,079,088, which is a continuation of application No. 13/291,545, filed on Nov. 8, 2011, now Pat. No. 9,646,755.

(60) Provisional application No. 61/413,913, filed on Nov. 15, 2010.

(51) Int. Cl.

| | |
|---|---|
| ***H01F 27/29*** | (2006.01) |
| ***H01F 27/02*** | (2006.01) |
| ***H01F 27/30*** | (2006.01) |

(52) U.S. Cl.

CPC ..... *H01F 27/02* (2013.01); *H01F 27/306* (2013.01); *Y10T 29/49071* (2015.01)

(58) Field of Classification Search

USPC ..... 336/192, 90, 229

See application file for complete search history.

(56) References Cited

U.S. PATENT DOCUMENTS

| | | | | |
|---|---|---|---|---|
| 5,212,345 A * | 5/1993 | Gutierrez | ..... | H01F 27/292 174/556 |
| 5,309,130 A * | 5/1994 | Lint | ..... | H01F 17/062 336/192 |
| 6,753,749 B1 * | 6/2004 | Chin | ..... | H01F 27/027 336/83 |

(Continued)

*Primary Examiner* — Elvin G Enad
*Assistant Examiner* — Kazi S Hossain
(74) *Attorney, Agent, or Firm* — Gazdzinski & Associates, PC

(57) ABSTRACT

A low profile, small size and high performance electronic device for use in, e.g., electronic circuits which provides maximum creepage and/or clearance distances. In one embodiment, the device is configured for a small footprint and utilizes two or more windings that require isolation. The exemplary device includes a self-leaded header made from a unitary construction which comprises a generally a box-like support body having a cavity for mounting a circuit element with primary and secondary windings, the support body having a base and a plurality of leads extending generally horizontally outward from the support body adjacent the base, the support body having one side opening on a side with leads permitting the loading of the inductive device in the cavity, and a routing channel residing on the top of the base, so as to maximize the creepage and clearance distance of the electronic device. Shaped-core and other embodiments are also disclosed.

20 Claims, 6 Drawing Sheets

(56) References Cited

U.S. PATENT DOCUMENTS

| | | | | |
|---|---|---|---|---|
| 7,573,364 | B2 * | 8/2009 | Suzuki | H01F 27/2895 336/192 |
| 2009/0009276 | A1 * | 1/2009 | Jidaisho | H01F 27/027 336/90 |

* cited by examiner

ADVANCED ELECTRONIC HEADER APPARATUS AND METHODS

PRIORITY

This application is a continuation of, and claims the benefit of priority to, co-owned U.S. patent application Ser. No. 15/589,809 filed May 8, 2017 of the same title, issuing as U.S. Pat. No. 10,079,088 on Sep. 18, 2018, which is a continuation of, and claims the benefit of priority to, U.S. patent application Ser. No. 13/291,545 filed Nov. 8, 2011 of the same title, now U.S. Pat. No. 9,646,755, which claims the benefit of priority to U.S. Provisional Patent Application Ser. No. 61/413,913 filed Nov. 15, 2010 of the same title, each of the foregoing being incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Field of the Invention

The present invention relates generally to electrical and electronic component packaging, and more particularly in one exemplary aspect to a package configured to maximize the creepage and clearance distances in inductive devices with two or more windings that require isolation.

2. Description of Related Technology

A myriad of different configurations of inductive electronic devices are known in the prior art. Many of these inductive devices utilize so-called surface mount technology to permit more efficient automatic mass production of circuit boards with higher component densities. With this approach, certain packaged components are automatically placed at preselected locations on top of a printed circuit board, so that their leads are registered with, and lie on top of, corresponding solder pads. The printed circuit board is then processed by exposure to infrared or vapor phase soldering techniques to reflow the solder and thereby establish a permanent electrical connection between the leads of the device and their corresponding conductive paths on the printed circuit board.

Two examples of prior art inductive devices are illustrated in FIGS. 1-4 herein. While both of the prior art devices illustrated in FIGS. 1-4 are adequate in performing their mechanical and electrical functions, they do not address maximization of creepage and clearance distances, a consideration which is especially pertinent with the need to further reduce electronic component size. See inter alia ISO 60664-1, definitions 1.32 and 1.3.3, which are incorporated by reference herein. Clearance in this context comprises the shortest distance in air between two conductive components, while creepage comprises the shortest distance (through air) along an insulator between two conductive components.

For instance, the prior art package of FIGS. 1-2 utilizes a header element 10 with an open cavity formed in its bottom surface 20, where the wound coil 30 is mounted between two rows of pins 40, 50. In this device, the device core 60 is considered a conductor unless it is covered with a recognized insulator (tape, plastic case, etc.). So the "true" total clearance distance is the gap 70 from the primary pins 40 to the core 60, plus the gap 80 from the core 60 to the secondary pins 50. This reduces the total clearance by the diameter of the core 60. This is also true with many shape core/bobbin packages.

Similar logic applies to the prior art self-leaded inductive device of FIGS. 3-4.

Accordingly, despite the broad variety of prior art inductive device configurations, there is still a salient need for smaller form factor devices (including those having a small footprint) which adequately address considerations such as creepage and clearance, while simultaneously offering improved or at least comparable electrical performance over prior art devices. The ability to use such devices with a conventional automated "pick and place" or other production machine is also highly desirable.

SUMMARY OF THE INVENTION

The present invention addresses the foregoing needs by providing, inter alia, compact inductive apparatus and methods for use and manufacturing thereof.

In a first aspect of the invention, an electronic component optimized for creepage and/or clearance is disclosed. In one embodiment, the device comprises a surface mount inductive device that includes primary and secondary windings, the latter which are routed via a lateral (side) port so as to enhance creepage and/or clearance. In one variant, the inductive device is self-leaded.

In a second aspect of the invention, an inductive device is disclosed. In one embodiment, the device comprise: a self-leaded header, the header comprising: a base portion; a plurality of self-leaded terminals protruding outwardly from the base portion on at least two sides thereof; a lateral port disposed proximate at least one of the two sides; and a winding post; and one or more conductive windings, the windings routed to engage at least one of the self-leaded terminals and disposed at least partly about the winding post. At least some of the conductive windings exit via the port and are routed to the terminals disposed on a side of the at least two sides which is not proximate the port.

In another embodiment, the inductive device includes: a wound electronic component; a housing comprising a cavity with an opening; and a plurality of interface terminals disposed on sides of the housing. The opening is directed towards one of the sides, thereby increasing at least one of creepage and/or clearance distance for the inductive device.

In one variant, the interface terminals are disposed on opposing sides of the housing.

In another variant, the opening is oriented substantially orthogonal to a mounting plane associated with the inductive device, and a portion of the interface terminals are disposed on a side of the housing that is most distant from the opening of the cavity.

In another variant, the plurality of interface terminals are disposed on a base portion of the inductive device, and the base portion and the housing comprise a substantially unitary component.

In a third embodiment, the inductive device includes: a header, the header comprising: a base portion; a housing portion; a plurality of terminals protruding outwardly from the base portion on at least two sides thereof; and a lateral port disposed in the housing portion and proximate at least one of the two sides; and one or more conductive windings, the windings routed to engage at least one of the terminals and disposed at least partly about an edge of the lateral port.

In one variant, at least some of the conductive windings exit via the port and are routed to the terminals disposed on one of the at least two sides which is not proximate the port.

In another variant, the lateral port is configured so as to enable the insertion of an electronic component within the housing portion via the port.

In yet another variant, the inductive device further includes a winding routing channel disposed externally to the housing portion of the header.

In still another variant, the inductive device further comprising a retention feature that is disposed adjacent the winding routing channel.

In a further variant, the lateral port edge further includes one or more notch features, and the housing portion includes a shape-core device.

In a third aspect of the invention, a creepage/clearance-optimized header element is disclosed.

In a fourth aspect of the invention, a method of manufacturing the aforementioned inductive device is disclosed. In one embodiment, the method includes: winding an electronic component with at least a primary winding and a secondary winding, the primary and secondary windings having wiring ends associated therewith; placing the wound electronic component within a housing cavity, the housing cavity having an opening that is oriented substantially orthogonal to a mounting surface associated with the inductive device; terminating one of the primary or secondary wiring ends to one or more interface terminals disposed adjacent the opening; and terminating the other one of the primary or secondary wiring ends to one or more interface terminals disposed opposite the opening.

In one variant, the act of terminating the other one of the primary or secondary wiring ends to one or more interface terminals disposed opposite the opening further includes routing the other one of the primary or secondary wiring ends around an edge of the opening.

In another variant, the method further includes disposing the other one of the primary or secondary wiring ends into a wire routing channel, the wire routing channel being disposed between the edge of the opening and the one or more interface terminals disposed opposite the opening.

In a fifth aspect of the invention, a method of optimizing creepage and/or clearance in an electronic device is disclosed.

In a sixth aspect of the invention, a method of operating a creepage and/or clearance-optimized electronic device is disclosed.

Other features and advantages of the present invention will immediately be recognized by persons of ordinary skill in the art with reference to the attached drawings and detailed description of exemplary embodiments as given below.

BRIEF DESCRIPTION OF THE DRAWINGS

The features, objectives, and advantages of the invention will become more apparent from the detailed description set forth below when taken in conjunction with the drawings, wherein.

Figure 5:
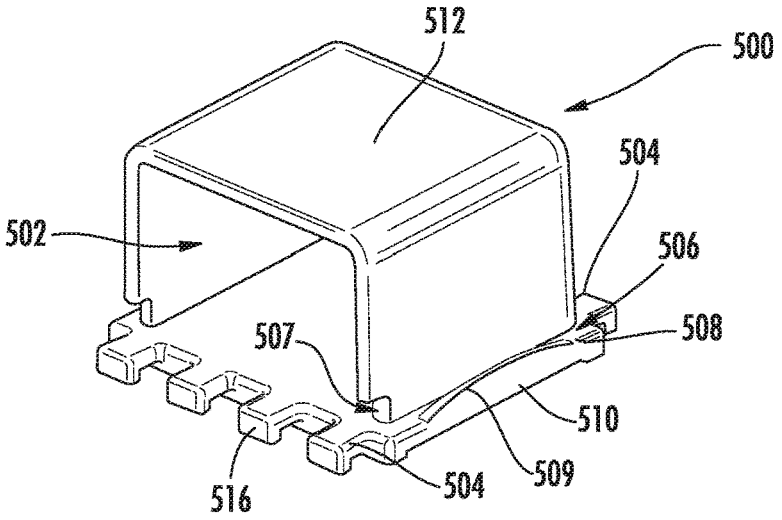
FIG. 5 is a top perspective view of a header element in accordance with one embodiment of the present invention.
Figure 1:
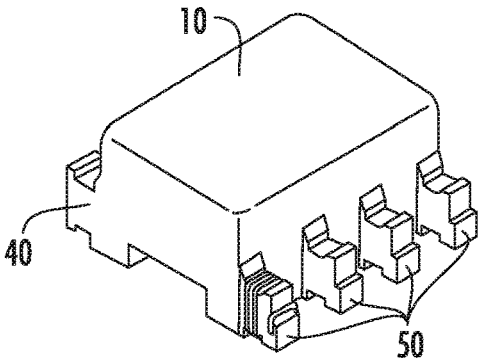
FIG. 1 (Prior Art)
FIG. 1 is a top perspective view of a prior art self leaded surface mounted coplanar header.
Figure 2:
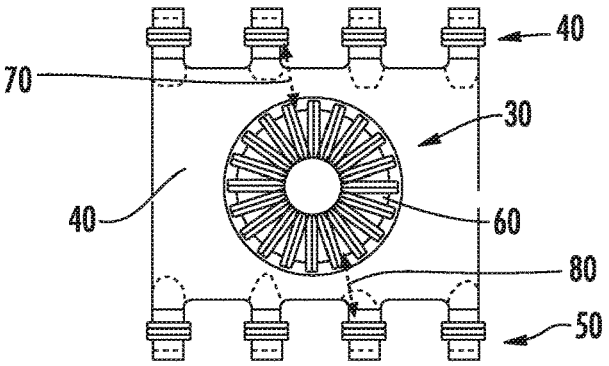
FIG. 2 (Prior Art)
FIG. 2 is a bottom elevation view of the prior art self leaded surface mounted coplanar header of FIG. 1.
Figure 3:
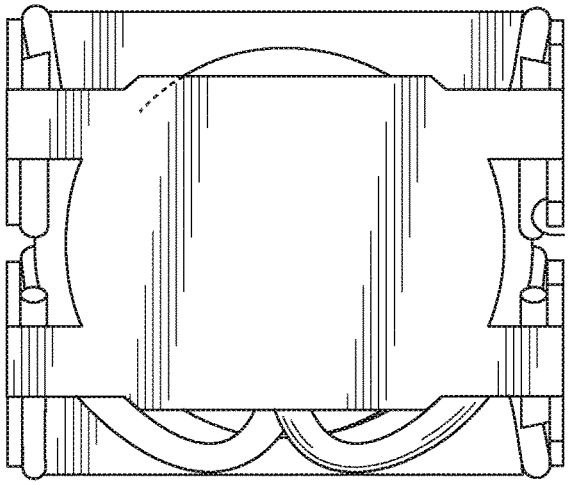
FIG. 3 (Prior Art)
FIG. 3 is a top elevation view of a prior art self-leaded surface mount coil lead form.
Figure 4:
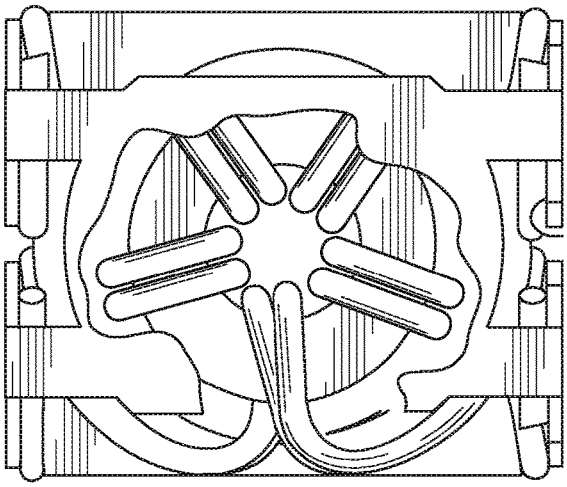
FIG. 4 (Prior Art)
FIG. 4 is a top elevation view (partial cutaway) of the prior art self-leaded surface mount coil lead form of FIG. 3, illustrating the interior cavity and wound coil.

All Figures disclosed herein are © Copyright 2009-2010 Pulse Electronics, Inc. All rights reserved.

DETAILED DESCRIPTION OF THE PREFERRED EMBODIMENT

Reference is now made to the drawings wherein like numerals refer to like parts throughout.

As used herein, the terms "bobbin", "form" (or "former") and "winding post" are used without limitation to refer to any structure or component(s) disposed on or within or as part of an inductive or other device which helps form or maintain one or more windings of the device.

As used herein, the terms "electrical component" and "electronic component" are used interchangeably and refer to components adapted to provide some electrical and/or signal conditioning function, including without limitation inductive reactors ("choke coils"), transformers, filters, transistors, gapped core toroids, inductors (coupled or otherwise), capacitors, resistors, operational amplifiers, and diodes, whether discrete components or integrated circuits, whether alone or in combination.

As used herein, the term "inductive device" refers to any device using or implementing induction including, without limitation, inductors, transformers, and inductive reactors (or "choke coils").

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

Overview

The present invention provides, inter alia, improved electronic apparatus and methods for manufacturing and utilizing the same. As previously discussed, typical prior art inductive devices with two or more windings often terminate the winding ends by routing the wire in the most direct route to their respective leads (see discussion of FIGS. 1-4 supra). This termination arrangement reduces the devices creepage and clearance distances which, if not sufficiently large, may possibly reduce reliability and/or performance of the device due to, inter alia, damaging the insulation material. Increasingly space and performance-conscious applications demand high electrical performance and low cost with a small form factor.

The present invention is adapted to overcome the disabilities of the prior art by providing a electronic component package configuration which, in one embodiment, routes one of the windings utilizing triple-insulated wire around the outside of the package body, thereby maximizing the creepage and clearance distances between the primary and secondary windings. Advantageously, the basic header element can be configured in any number of different ways to adapt to different types of uses (e.g., inductor, transformer, etc.) and surface mount or through-hole applications. The geometry of the header element can also be varied as required to achieve a particular point within the performance/cost/size "design space".

Moreover, the placement of the opening in the exemplary configuration of the header element is optimized for heat dissipation; i.e., heat generated by the electronic element inside the cavity of the header element can readily flow outward and upward, in comparison to some prior art "open bottom" designs, which tend to capture more heat energy.

Exemplary embodiments of the device are also advantageously adapted for ready use by a pick-and-place, tape-reel, and other similar automated manufacturing devices, and are also self-leaded so as to eliminate the necessity for insert molded conductive leads which can, in some instances, increase the overall cost of the device.

Multi-component and alternate (e.g., shape-core) embodiments are also disclosed.

DETAILED DESCRIPTION OF EXEMPLARY EMBODIMENTS

Detailed descriptions of the various embodiments and variants of the apparatus and methods of the invention are now provided. While primarily discussed in the context of inductive devices implementing a primary and secondary winding, the various apparatus and methodologies discussed herein are not so limited. In fact, many of the apparatus and methodologies described herein are useful in the manufacture of any number of electronic or signal conditioning components that can benefit from increasing creepage and clearance distances.

In addition, it is further appreciated that certain features discussed with respect to specific embodiments can, in many instances, be readily adapted for use in one or more other contemplated described embodiments. It can be readily recognized by one of ordinary skill, given the present disclosure that many of the features described herein possess broader usefulness outside of the specific examples and implementations with which they are described.

Header and Inductive Device—

Referring now to FIG. 5, an exemplary embodiment of a header element 500 for use with an inductive device is illustrated. The header element 500 of FIG. 5 offers several design features which allow the resulting inductive device to be compact in size, easy to manufacture, have comparatively high electrical performance, and comparatively low in cost to produce, and which help ensure repeatability of construction during the manufacturing process. These design features include: (1) a substantially unitary construction; (2) maximization of the creepage distance by increasing length of the wire routing of the winding; and (3) maximization of the clearance distance by removing the core as a shorted path between primary and secondary leads; and (4) use of a lateral or side opening/heat vent within the header element.

The header element 500 of FIG. 5 is produced, in an exemplary embodiment, from an injection molded polymer in a unitary configuration. In one implementation, the polymer is a material that is resistant to high temperatures (such as those experienced during solder reflow operations), such as a well known liquid crystal polymer (LCP), a phenolic resin, or the like. Specifically, the use of high temperature polymers enables, inter alia, the use of the header in both: (1) solder dipping or similar operations (i.e., direct exposure of the header to molten solder without damage); and (2) solder reflow processes, thereby enabling the header to be surface-mounted to a substrate such as PCB or motherboard.

The unitary header element construction of the embodiment of FIG. 5 includes a body portion having generally a box-like housing configuration for holding one or more electrical or electronics component, and providing termination leads for the electrical component comprising protruding outwardly therefrom, although it will be appreciated that other shapes may readily be used. In addition, the box-like body portion includes one side opening 502 disposed on a side having self-leaded legs or terminal posts 504 which permits the loading of the electronic component into the housing cavity, as well as heat dissipation. The header element 500 additionally comprises of a winding routing channel 506 located on the top surface 508 of the base plane 510 that runs along the outside of the housing. In alternate embodiments (not illustrated), the winding routing channel(s) may reside on various other portions of the header element. For example, the routing channel could be located along the bottom of the base plane 510 of the header element, or along the top 512 of the box-like housing.

As the components of the embodiment of FIG. 5 are integrally molded to form a unitary body, there is advantageously no need to separately procure and assemble multiple discrete components.

Protruding from the header element 500 are a number of self-leaded terminals 504 that are, in the illustrated example, produced from the same material and manufacturing process that created the underling body, although this is not a strict requirement of practicing the invention. Other types of terminals may be used as well, examples of which are described subsequently herein. The use of self-leaded terminals is described in, for example, co-owned U.S. Pat. No. 5,212,345 issued May 18, 1993 and entitled "Self leaded surface mounted coplanar header", the contents of which are incorporated herein by reference in their entirety. The self-leaded terminals 504 are generally rounded or elliptical in shape in order to accommodate the windings of the wire without damaging the wire when it is wrapped around the terminals, although other shapes (e.g., octagon, hexagon, square, rectangle, etc.) may be used if desired. At the outer end of the terminals is an optional flange 516, which helps maintain the windings onto the spool portion of the terminals that receives the windings. A notched or other shape may also or alternatively be utilized in order to help retain the wiring ends in a desired position.

The illustrated header element 500 of FIG. 5 also includes two or more notch features 507 disposed at the interface of the box-like upper portion and the base plane 510 on the opening side of the header element. These features 507 help route and guide the windings as shown best in FIG. 6. These features, while shown at the interface described, may be placed in other locations if desired in accordance with the desired winding routing.

Moreover, the illustrated embodiment includes two "wing" retention features 509 to help retain the routed winding(s) in place as it/they run from the open side of the header element 500 to the closed side. It will be appreciated by those of ordinary skill that these features may take on literally any shape or type, including without limitation a closed channel, and open "box" channel with or without a friction fit, clips, or even adhesives.

It is appreciated that while eight (8) terminals are illustrated in the embodiment of FIG. 5, more or less terminals could be readily used for e.g., the purpose of providing less or more additional electrical connections.

As an alternative to the use of self-leaded terminals, the use of insert molded or post inserted metallic leads (e.g., "gull wing" leads, or even through-hole pin-type terminals) could also be substituted in place of the self-leaded terminals illustrated in FIG. 5. Such leads may be surface mount or through-hole (or a mixture thereof) as dictated by the desired application. Other types of surface mounting approaches may also be used consistent with the invention, such as a discrete terminal array to which the inductive device header element 500 is mated, or an integral terminal array such as a ball grid array (BGA) or the like.

The conductive wiring ends are then secured to respective self-leaded terminals, such as by wrapping one or more turns around the terminal(s). It will also be recognized that in certain embodiments, it may be desirable to wrap two or more wiring ends around a common terminal. To ensure electrical contact in such cases, a eutectic solder or other material may be used if desired.

Figure 6:
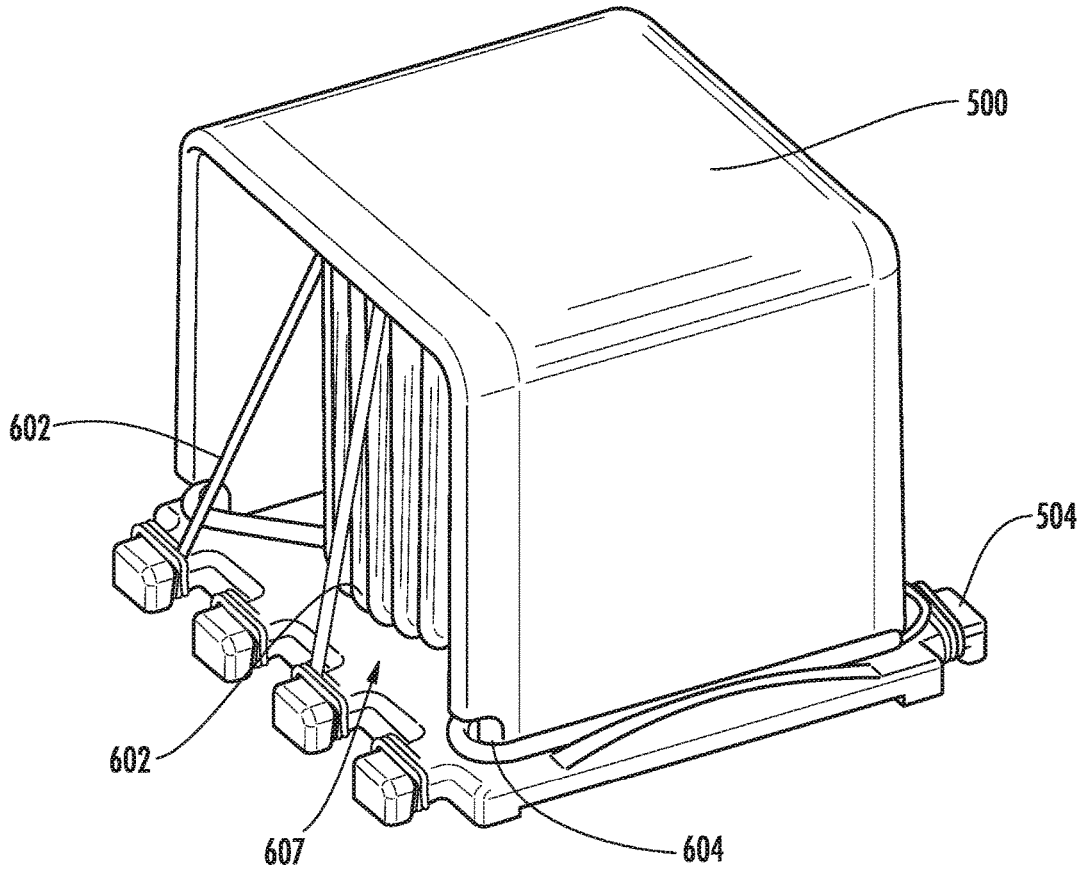
FIG. 6 is a top perspective view of one embodiment of a self-leaded inductive device which incorporates the header element illustrated in FIG. 5.

FIG. 6 illustrates the header element 500 of FIG. 5 loaded with an inductive device comprising (i) two primary windings 602 formed using "magnet" wire of the type well known in the electronic arts, and (ii) a secondary winding 604 formed using triple insulated wire of the type known in the art, although it will be recognized that other types and numbers of winding may be used consistent with the invention. For example, insulated wires could be used for both the primary and secondary windings, or the primary may be insulated (e.g., triple insulated and the secondary windings formed from magnet wire. Myriad different combinations may be used consistent with the desired application and performance requirements (e.g., UL insulation standard requirements).

The primary and secondary windings are wound around one or more core elements 607, such as those of toroidal shape and power iron or ferrite-based construction, of the type well known in the electronic arts, although it will be appreciated that other materials and/or shapes may be used consistent with the invention. The secondary winding 604 is routed from the opening 502 (see FIG. 5) of the header element on the top surface of the base plane 510 along the outside of the box-like portion of the element 500, and terminated to the self-leaded terminals 504. In alternative embodiments, the header element may provide various locations of the routing channels as previously described. Note that the portion of the windings 602, 604 that are wound about the terminals 504 extend below the bottom surface of the header element 500, so that they can be surface-mounted to an external substrate as previously discussed herein. In alternative embodiments to that illustrated, the terminals could be raised or alternatively lowered, such as to e.g., accommodate larger or smaller gauge windings, depending on the needs of the particular device implementation.

Furthermore standoffs or "feet" (not shown) may also be incorporated on the underside of the header for the purpose of, inter alia, providing a wash area underneath the mounted device for the purposes of removing corrosive chemical compounds, or for adjusting the installed height of the device on the substrate with respect to the height of the terminal pads on the substrate (which may be different in some cases); see e.g., U.S. Pat. No. 5,212,345 previously incorporated herein. Alternatively, the bottom surface of the windings may be made coplanar with the bottom surface of the header base (so that the bottoms of the windings and the base plane of the header contact a flat surface effectively simultaneously), or the bottoms of the terminals may extend below the plane of the header base (as shown in FIG. 5); see also co-owned U.S. Pat. No. 5,309,130 issued May 3, 1994 entitled "Self leaded surface mount coil lead form", incorporated herein by reference in its entirety.

It is appreciated that while the embodiment of FIGS. 5-6 shows a single inductive device within the interior cavity of the header element 500, the header element and device (including those of other embodiments described subsequently herein with respect to FIGS. 7-9) may be constructed so as to accommodate multiple inductive devices, such as in a side-by-side, over-under, or front-to-back configuration (not shown). In such cases, it is also possible to "cross over" the windings of the respective devices if desired, or rout the windings so that they do not cross over, depending on the desired configuration.

Figure 7:
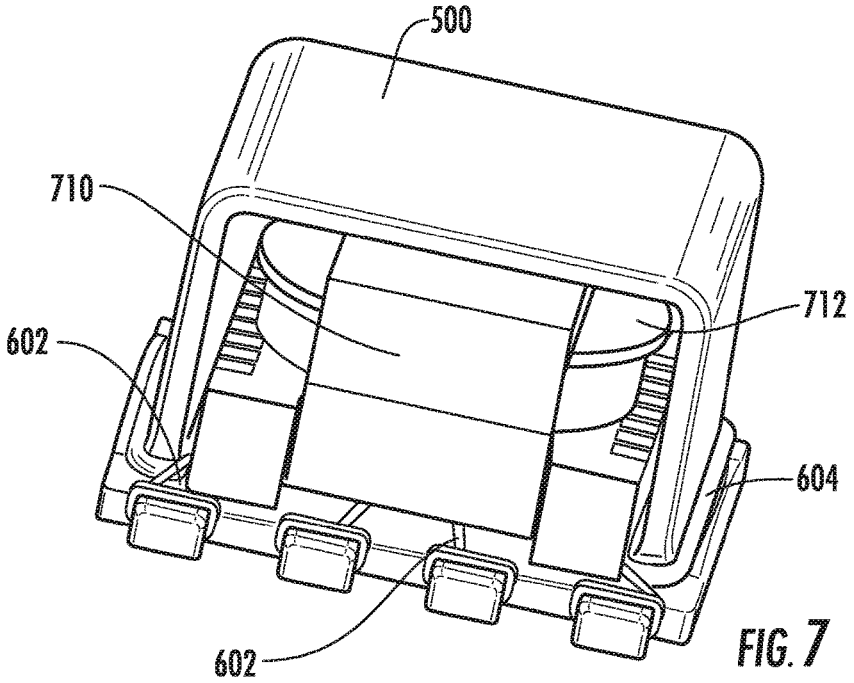
FIGS. 7-8 are illustrate another embodiment of an inductive device according to the invention, wherein a polymer header element is used in conjunction with an internal bobbin and power iron or ferrite core component.
Figure 8:
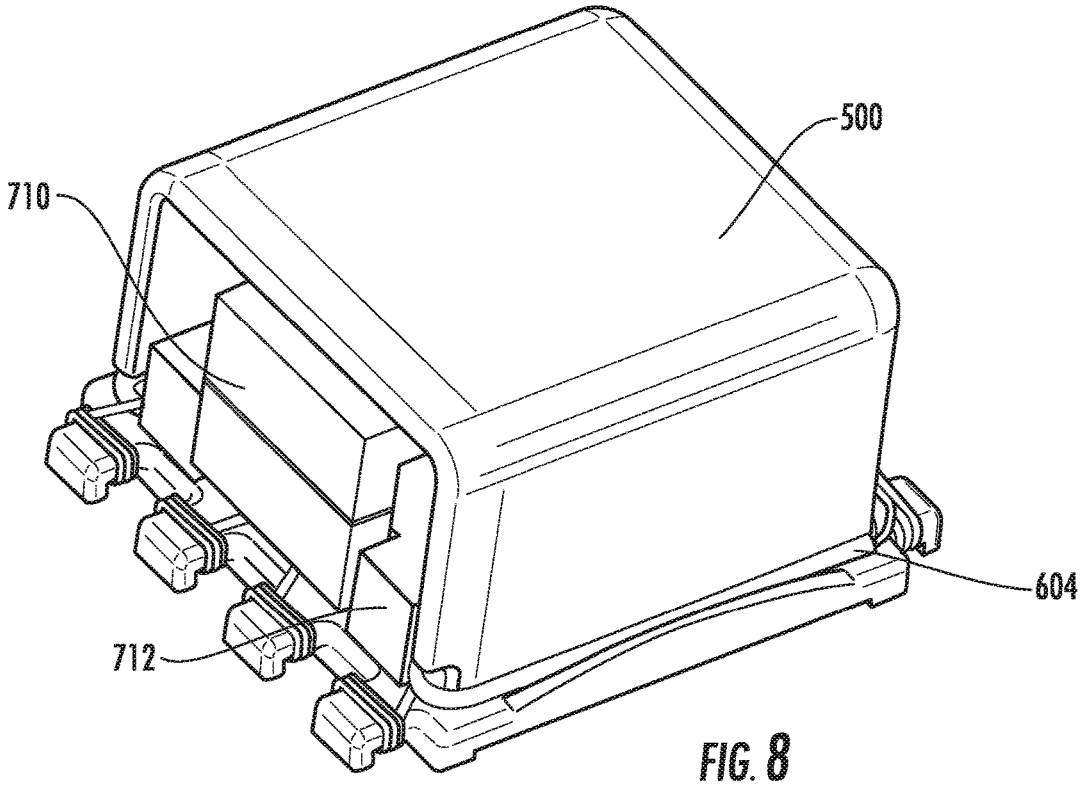
Figure 9:
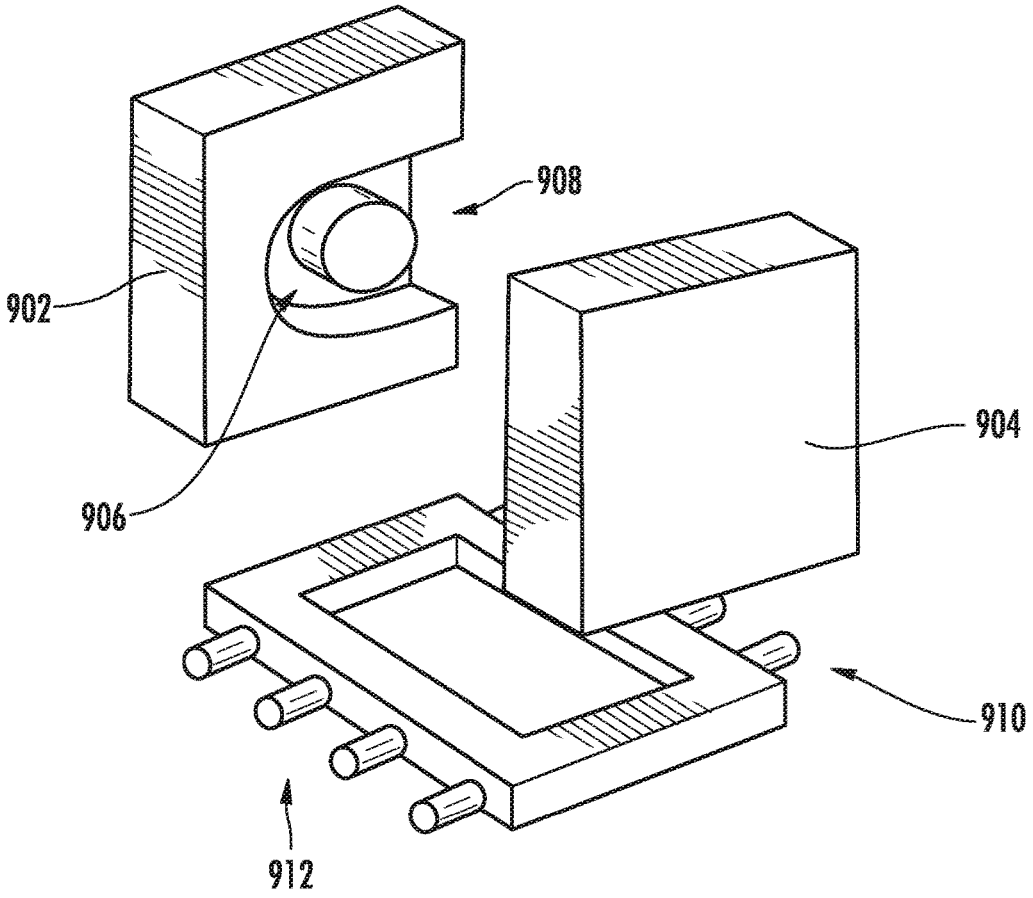
FIG. 9 is an exploded perspective view of another embodiment of an inductive device according to the invention, wherein a shape-core assembly is used.

Referring now to FIGS. 7-8, yet another configuration of the inductive device of the invention is described. As shown in the Figures, the device comprises a header element 500 generally similar to that of FIG. 5, yet the inductive device received in the interior cavity includes a bobbin or other former 712, as well as two power iron or ferrite partial wrap-around core elements 710*a*, 710*b* so as to achieve higher inductance values or higher current saturation levels by the introduction of gaps between the two core elements, although it will be recognized that single-piece wrap-around elements or yet other configurations may be used if dictated by the application.

Shape-Core Embodiments—

In another alternative embodiment (FIG. 9), a shape-core device (e.g., power iron or ferrite) such as that described in co-owned U.S. Patent Application Publication No. 20100026438 to Gilmartin, et al. published Feb. 4, 2010 and entitled "FORM-LESS ELECTRONIC DEVICE ASSEMBLIES AND METHODS OF OPERATION", the contents of which are incorporated herein by reference in their entirety, may be used as the basis of the inductive device. For example, in one such configuration, two shape-core pieces 902, 904 or "halves" are formed so as to have an interior channel 906 for primary and secondary windings (not shown), the latter which can be formed into one or more bonded windings if desired, and disposed within the interior channel. The interior channel communicates with a winding port 908 on the side of the shaped core (as opposed to the bottom on prior art devices). As in the embodiment of FIG. 5 herein, one set of terminals 910 (self leaded or otherwise, such as via a terminal array mated to the bottom of the core pieces) are disposed proximate the core side opening, while the other set of terminals 912 is disposed opposite the opening on the other side of the core assembly. In this fashion, a portion of the windings exiting the opening 908 are wrapped or routed around the side of the core assembly (as in the embodiment of FIG. 5 herein), thereby providing the desired creepage and clearance properties previously described herein.

Furthermore, a combination of the foregoing alternatives can be utilized in yet another alternative embodiment. These and other variations would be readily apparent to one of ordinary skill given the present disclosure.

Exemplary Inductive Device Applications—

As previously discussed, the exemplary inductive devices described herein can be utilized in any number of different operational applications. In addition to wideband RF transformers, other possible electrical applications for the inductive devices described herein include, without limitation, common mode chokes, power and isolation transformers, baluns, directional couplers for use in, inter alia, basic inductors, amplifiers and signal monitor points; and RF splitters and combiners for use in, inter alia, cable media products and distribution equipment. These and other inductive device applications would be readily apparent to one of ordinary skill given the present disclosure.

Methods of Manufacture—

Figure 10:
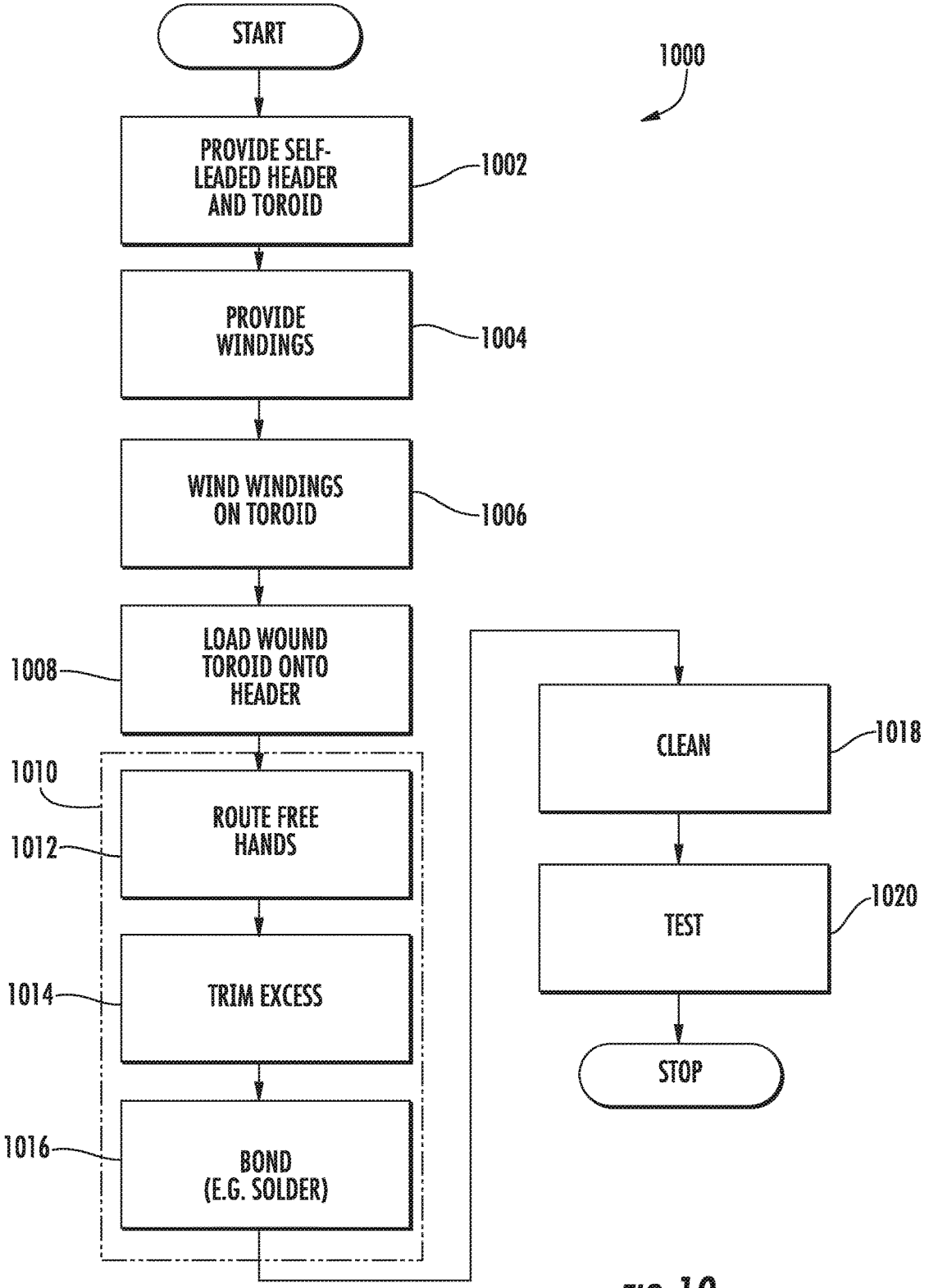
FIG. 10 is a logical flow diagram illustrating one exemplary embodiment of a process flow for manufacturing the self-leaded inductive device illustrated in FIG. 6.

Referring now to FIG. 10, an exemplary embodiment of the method 1000 for manufacturing the present invention is now described in detail.

It will be recognized that while the following description is cast in terms of the device of FIGS. 5-6, the method is generally applicable to the various other configurations and embodiments of devices disclosed herein with proper adaptation, such adaptation being within the possession of those of ordinary skill in the electrical device manufacturing field when provided the present disclosure.

In a first step 1002 of the method, one or more self-leaded header elements 500 and power iron or ferrite toroid cores 606 are provided. The headers and toroids may be obtained by purchasing them from an external entity, or they can be indigenously fabricated by the assembler. The header is in one embodiment, as was previously discussed, manufactured using a standard injection molding process of the type well understood in the polymer arts, although other constructions and processed may be used.

Next, one or more primary windings 602 and the secondary winding are provided (step 1004). The primary windings are preferably a copper-based alloy "magnet wire" as discussed above, although other types of conductors (whether unitary strand, multi-filar, etc.) may be used. The secondary winding 604 may comprise a copper-based alloy "triple insulated wire" as discussed above, although this is not a requirement of practicing the invention.

Per step 1006, the windings 602, 604 are next wound onto the toroid core in the desired configuration (such as, e.g., that of FIG. 6). The toroid core may be hand-wound, or alternatively wound on a winding machine.

At step 1008, the wound toroid is loaded into the header element 500. The primary windings lead wires are wound onto the desired self-leaded terminal legs 504 closet to the side opening 502 in the header element body. The secondary winding lead wires are routed from the side opening 502 in the header element body, in the routing channel residing on the top of the base of the header and wound onto the desired self-leaded terminal legs 504 on the opposite side of the header.

Next, per step 1010, each wound header is placed on, e.g., an assembly and solder fixture of the type known in the art, and the free ends of the windings 602, 604 terminated to the terminals of the wound header. This termination in the present embodiment comprises (i) routing the free ends onto the terminals 504 and winding them or otherwise restraining them in position (step 1012), (ii) trimming any excess lead wire from the terminal (step 1014), and (iii) bonding them using e.g., a water soluble or resin based solder flux along with a eutectic solder (step 1016) if desired. In one variant of the method 1000, the wound header terminals 504 are immersed in solder at a temperature of approximately 395 degrees C. (+/−10 C) and dwell time of 2-4 seconds, although other approaches, types of solder, and solder profiles may be used. Alternatively, a conductive epoxy can be utilized to bond the windings onto the header and to provide an electrically conductive surface for mating to an external substrate Lastly, per steps 1018 and 1020, the headers are optionally cleaned (e.g., for 2-5 minutes in either de-ionized water or isopropyl alcohol or another solvent) using an ultrasonic cleaning machine, and then tested if desired, thereby completing the device manufacturing process.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An inductive device for surface mounting onto a surface of a substrate, the inductive device comprising:

a header element, the header element comprising a generally box-like housing comprising a cavity, the cavity having a wire wound electronic component disposed therein, the header element comprised of a top surface that is generally parallel with the surface of the substrate when the inductive device is mounted thereon, an opening to the cavity disposed on a side surface of the header element, the opening defining a plane that is oriented generally orthogonal with the top surface of the header element, a pair of side surfaces that are disposed adjacent the opening, the pair of side surfaces each oriented generally orthogonal with the top surface of the header element, and a back surface disposed on an opposing side of the opening to the cavity, the back surface oriented generally orthogonal with the top surface of the header element, the header element further comprising a plurality of terminals protruding outwardly therefrom, a first set of the plurality of terminals being disposed below the opening to the cavity of the header element and a second set of the plurality of terminals being disposed adjacent the back surface of the header element, the header element further comprising a plurality of open channels that are disposed on an external surface of the header element, each of the plurality of open channels configured to help retain respective wires as they are routed from the opening to the cavity towards the second set of the plurality of terminals disposed adjacent the back surface; and the wire wound electronic component disposed within the cavity of the header element, the wire wound electronic component comprised of the respective wires that are routed within respective ones of the plurality of open channels, the wire wound electronic component further comprised of a second wire that exits the cavity of the header element and is routed to one of the first set of the plurality of terminals.

2. The inductive device of claim 1, wherein the plurality of open channels configured to help retain the respective wires as they are routed from the opening to the cavity towards the second set of the plurality of terminals disposed adjacent the back surface is configured to increase at least one of creepage and/or clearance distance for the inductive device.

3. The inductive device of claim 2, wherein the wire wound electronic component comprises a pair of windings, the respective wires comprises a first of the pair of windings and the second wire comprises at least a portion of a second of the pair of windings.

4. The inductive device of claim 3, wherein:

the pair of windings comprises a primary winding and a secondary winding; and the secondary winding comprises the respective wires and the primary winding comprises the second wire.

5. The inductive device of claim 4, wherein the secondary winding comprises an insulation rating that is higher than the primary winding.

6. The inductive device of claim 1, wherein the plurality of terminals each comprises an insert molded metallic lead and the header element comprises a polymer material.

7. The inductive device of claim 6, wherein the respective wires comprises an insulation rating that is higher than that of the second wire.

8. The inductive device of claim 6, wherein the second wire comprises an insulation rating that is higher than that of the respective wires.

9. The inductive device of claim 6, wherein the cavity further comprises a bottom surface, the wire wound electronic component further configured to reside on the bottom surface of the cavity, the bottom surface of the cavity is further positioned at or above the first set of the plurality of terminals.

10. The inductive device of claim 9, wherein the plurality of channels are further positioned above the bottom surface of the cavity.

11. An inductive device for surface mounting onto a surface of a substrate, the inductive device comprising:

a header element, the header element comprising a cavity, the cavity configured to have a wire wound electronic component disposed therein, the header element comprised of a top surface that is generally parallel with the surface of the substrate when the inductive device is mounted thereon, an opening to the cavity disposed on a front surface of the header element, the opening defining a plane that is oriented generally orthogonal with both the surface of the substrate when the inductive device is mounted thereon and the top surface of the header element, the opening configured to receive the wire wound electronic component, a pair of side surfaces that are disposed adjacent the opening, the pair of side surfaces each oriented generally orthogonal with both the surface of the substrate when the inductive device is mounted thereon and the top surface of the header element, and a back surface disposed on an opposing side of the header element with respect to the opening to the cavity, the header element further comprising a plurality of terminals protruding outwardly therefrom, a first set of the plurality of terminals being disposed below the opening to the cavity of the header element and a second set of the plurality of terminals being disposed adjacent the back surface of the header element, the header element further comprising a plurality of open channels, each open channel disposed on a respective one of the pair of side surfaces of the header element, at least two of the plurality of open channels being configured to route a respective wire of the wire wound electronic component from the opening to the cavity to the back surface disposed on the opposing side of the opening to the cavity, the plurality of open channels being disposed external to the cavity of the header element; and the wire wound electronic component disposed within the cavity of the header element, the respective wires of the wire wound electronic component are routed about a respective edge of the pair of side surfaces of the header element, a first wire of the respective wires being routed along a first open channel of the plurality of open channels of the header element to one of the second set of the plurality of terminals disposed adjacent the back surface of the header element, a second wire of the respective wires being routed along a second open channel of the plurality of open channels to another one of the second set of the plurality of terminals disposed adjacent the back surface of the header element.

12. The inductive device of claim 11, wherein the cavity further comprises a bottom surface, the wire wound electronic component further configured to reside on the bottom surface of the cavity, the bottom surface of the cavity is further positioned at or above the first set of the plurality of terminals being disposed below the opening to the cavity of the header element.

13. The inductive device of claim 12, wherein the plurality of open channels are further positioned at or above the bottom surface of the cavity.

14. The inductive device of claim 13, wherein the routing of the respective wires along respective open channels of the header element to respective ones of the second set of the plurality of terminals disposed adjacent the back surface of the header element is configured to increase at least one of creepage and/or clearance distance for the inductive device.

15. The inductive device of claim 14, wherein the plurality of terminals each comprises an insert molded metallic lead.

16. The inductive device of claim 15, wherein the wire wound electronic component further comprises a second set of wires that are routed to respective ones of the first set of the plurality of terminals.

17. The inductive device of claim 16, wherein the opening to the cavity is configured to allow heat generated from the wire wound electronic component to flow outward and upward.

18. The inductive device of claim 16, wherein the respective wires routed to the respective ones of the second set of the plurality of terminals comprises an insulation rating that is higher than the second set of wires.

19. The inductive device of claim 18, wherein the insulation rating for the respective wires routed to the respective ones of the second set of the plurality of terminals comprises a triple-insulated rating.

20. The inductive device of claim 19, wherein the second set of wires comprises magnet wire.

* * * * *